United States Patent [19]

Pitman

[11] Patent Number: 4,462,546

[45] Date of Patent: Jul. 31, 1984

[54] ROTARY INDEXING NOZZLE FOR SWIMMING POOLS AND THE LIKE

[75] Inventor: Donald G. Pitman, Glendale, Ariz.

[73] Assignee: Caretaker Systems, Inc., Scottsdale, Ariz.

[21] Appl. No.: 414,459

[22] Filed: Sep. 2, 1982

[51] Int. Cl.[3] ..... B05B 3/08

[52] U.S. Cl. ..... 239/97

[58] Field of Search ..... 239/97, 99, 101

[56] References Cited

U.S. PATENT DOCUMENTS

| | | | |
|---|---|---|---|
| 129,125 | 7/1872 | Gibson . | |
| 1,568,250 | 1/1926 | Stanton . | |
| 2,878,066 | 3/1959 | Erwin | 299/141 |
| 3,131,867 | 5/1964 | Miller et al. | 239/97 |
| 3,220,653 | 11/1965 | Waldrum | 239/97 |
| 3,408,006 | 10/1968 | Stanwood | 239/97 X |
| 3,703,993 | 11/1972 | Schreiner | 239/231 |
| 3,888,417 | 6/1975 | Harmon | 239/97 |
| 4,200,230 | 4/1980 | Gould | 239/66 |

*Primary Examiner*—Andres Kashnikow
*Attorney, Agent, or Firm*—LaValle D. Ptak

[57] ABSTRACT

A rotary indexing nozzle head is provided wherein a dome like structure includes a rotating nozzle part supported by bearings interiorly thereof. The exit portion of the nozzle member includes a flexible bellows like structure which expands under the influence of water pressure and causes a lip thereon to engage an appropriately spaced wall for holding the nozzle in a specific location until the water pressure is relieved whereupon the bellows structure contracts and removes the engaging lip from the adjacent wall. A nozzle is caused to index by the jet of water impinging upon the curved surface of the lip 34 thereby causing the nozzle member to move sidewise, that is to say rotationally, until the lip is moved out far enough by the water pressure to cause the lip to engage the adjacent wall of the dome. The walls of the dome are spaced around its periphery so as in effect to provide openings for the jet of water to come through.

4 Claims, 3 Drawing Figures

ROTARY INDEXING NOZZLE FOR SWIMMING POOLS AND THE LIKE

BACKGROUND OF THE INVENTION

This invention relates to rotary indexing nozzles for swimming pool cleaning applications and it is an object of the invention to provide an improved nozzle and system of this character.

Rotary indexing nozzles for swimming pool applications are well-known to the art. Rotary nozzles for this purpose without indexing are also well-known. In the latter category such nozzles were usually not of the pop-up variety but projected above the surface of the swimming pool at all times. In this case, the nozzle were driven or rotated by means of various kinds of turbine devices usually through reduction gearing. Rotary indexing nozzles of the pop-up variety are usually rotated by some form of turbine effect including those devices wherein a jet is offset from the axis of rotation to create the rotative effect. In such devices it is known to provide a frictional manner of determining the amount of rotation with each operation of the pop-up nozzle. Indexing is also achieved by utilizing the force of a spring axially displaced in the nozzle for producing a walking effect and by cam type devices. Each of these types of devices performs its function within the desired design limitations, and it is an object of the invention to provide an improved rotary indexing nozzle which is simple in form, positive in operation and efficient during use.

Brief Description of the Invention

In carrying out the invention according to one form there is provided a rotary indexing nozzle head comprising, a housing adapted to be received in a water supply source, a jet nozzle member having a discharge end mounted for rotation in the housing, holding members uniformly spaced around the periphery of the housing adjacent the discharge end of the nozzle member, and means attached to the discharge end of the nozzle member for rotating the nozzle member and for engaging the holding members under the influence of water flowing through the nozzle; more specifically, the means attached to the discharge end of the nozzle member comprises a member expansible under the influence of water pressure and the expansible member has a projecting lip for engaging the holding members.

BRIEF DESCRIPTION OF THE DRAWINGS

For a better understanding of the invention, reference should be had to the accompanying drawing in which.

DESCRIPTION OF THE PREFERRED EMBODIMENT

Figure 1:
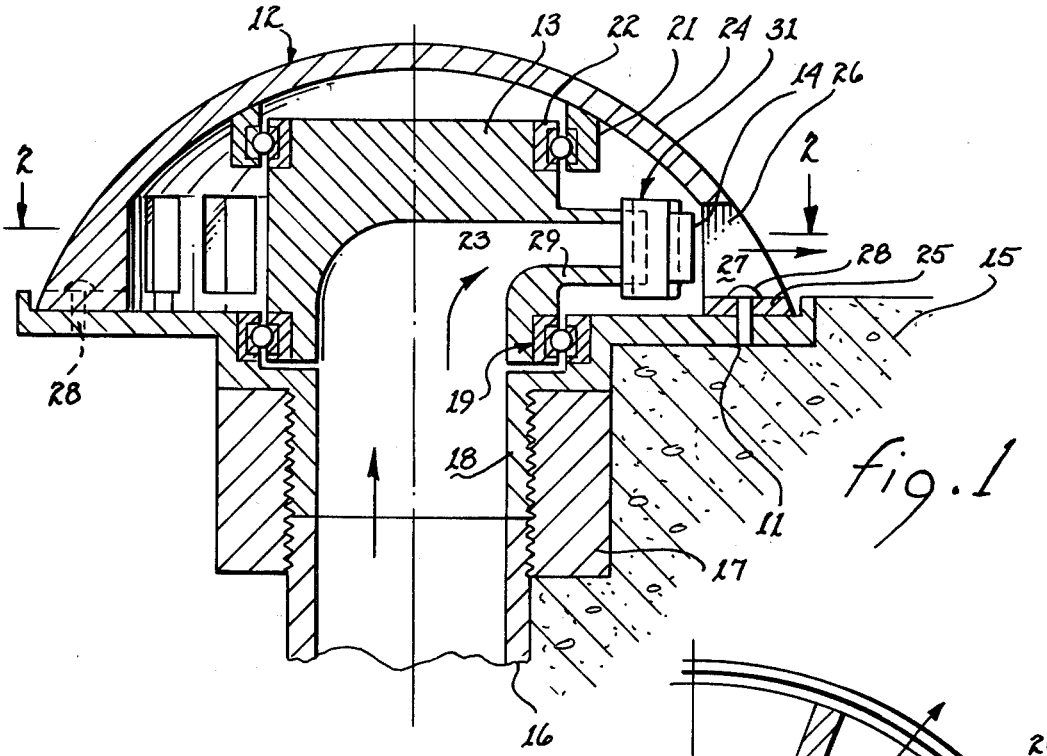
FIG. 1 is a sectional view of a rotary indexing nozzle according to the invention.

Referring to the drawing, the invention is shown as a rotary indexing nozzle 10 comprising a base member 11, a cover member 12, and a rotating member 13 mounted to the base 11 and inside of the cover 12. The rotating member 13 includes the nozzle 14.

The surface of the swimming pool in which the rotary indexing nozzle according to the invention may be mounted is represented in FIG. 1 by the bottom wall 15 which may be of the usual swimming pool type of material. The swimming pool wall, or pool bottom, includes pipes or conduits 16 imbedded therein through which water under pressure is supplied to the nozzle 10. The pipes or conduits 16 may terminate in a support collar 17 also imbedded in the pool bottom, the interior surface of the support collar 17 being threaded, for example, so as to receive the entry part 18 forming part of the base member 11.

Conveniently the base 11 and the entry member 18 may be cast, or molded, or formed in any other way as a single piece, perhaps, of synthetic material. The base member 11 includes a re-entrant portion at the juncture with the entry part 18 into which is received a bearing 19 for supporting one end of the rotating member 13. Interiorly of the cover 12 which, in effect, may be a dome shaped member, there is a depending annular ring 21 formed which is adapted to receive a second bearing 22 forming a part of the upper end of the rotating member 13.

The bearings 19 and 22 are axially disposed relative to each other and support the rotating member 13 during operation. The rotating member 13 supported at its upper and lower extremities by bearings 19 and 22 includes a passageway 23 which terminates in the nozzle 14, the passageway communicating with the interior of the entry part 18 and the supply pipe or conduit 16. Thus water coming into the conduit 16 discharges through the passageway 23 and the nozzle 14.

The cover member 12 includes a dome 24, a base rim member 25 and re-entrant walls 26. The re-entrant walls 26 and portions of the base rim 25 at the base of the dome 24 form passageways 27 through which the jet of water from the nozzle 14 emits. The walls 26 are so spaced that the desired number of passageways 27 around the periphery of the rim 25 are formed. In this way the appropriate number of jets emitting from the nozzle may be determined. The base member 11 and the rim 25 may be attached together by means of screws 28 for holding the structure in the assembled form. Of course before the screws 28 are put into position the rotating member 13 is placed interiorly in the appropriate location along with the bearings 19 and 22. At the discharge end of the passage 23 and the projecting part 29 terminating in the nozzle 14 there is a bellows like expansible nozzle part 31.

Figure 3:
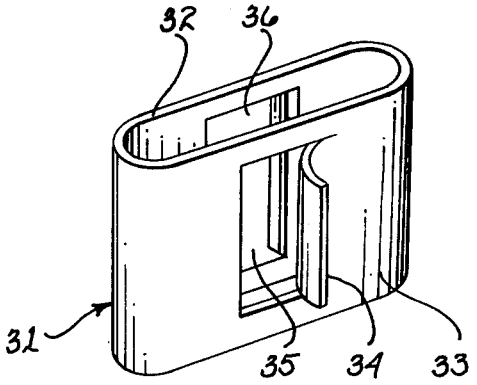
FIG. 3 is an enlarged view in perspective of an operative component of the applicant's structure.
Figure 2:
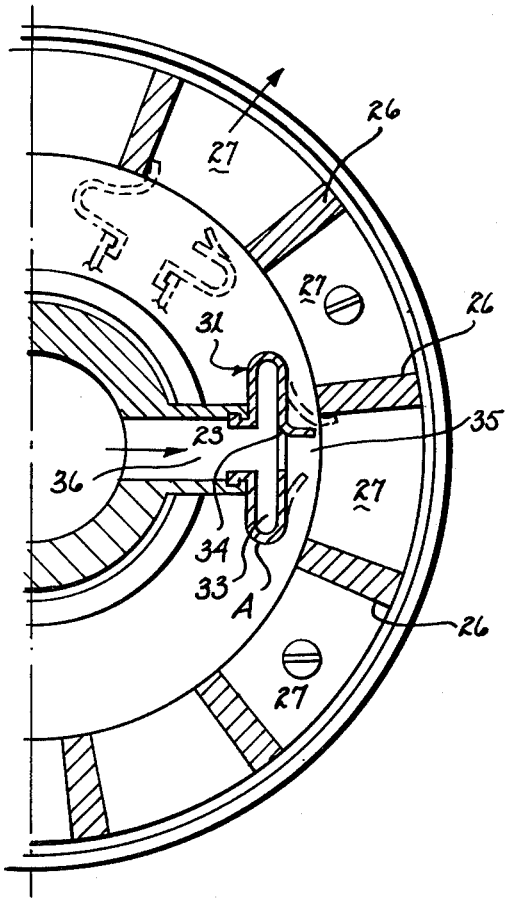
FIG. 2 is a sectional view taken substantially along the lines 2—2 of FIG. 1.

As may be seen in FIG. 3 and in sectional view of FIG. 2 the nozzle part 31 may be a flattened tubular like structure having an inner wall 32, an outer wall 33 and a lip 34 projecting from the outer wall 33. The projecting lip may be formed from the excess material of the outer wall 33 as the lip is bent outwardly to form the opening 35 through which the water jet emits. An opening 36 exists immediately inwardly by opening 35 and causes the bellows member 31 to fit over the end of the projecting nozzle 29 for holding the bellows member in place. The bellows member 31 doesn't have to be closed at its ends (perpendicular to jet) and may be open as shown. However if a closed member is desired it may be so utilized so long as the overall body of the bellows member 31 is sufficiently flexible to permit the outer wall 33 to flex and the lip 34 to move outwardly under the influence of water pressure.

Referring to FIG. 2, in the solid line position shown by the reference character A, the outer wall 33 is in its unstressed position as it would be when there is no water flowing through the nozzle passage 23. When water does flow through the nozzle passage 23 as shown by the arrow, that stream of water impinges upon the lip 33 and causes the lip to move outwardly with the flexing of the wall 33. Hence the end of the lip 34 engages the adjacent surface or edge of the wall 26. This causes the lip 34 to prevent further rotational movement of the nozzle member 14 and thereafter water flowing through the nozzle will eject onto the pool surface in front of the particular passageway 27. When water pressure is relieved such as by turning off the appropriate valve, water flow stops and the wall 33 assumes its normal position whereby the lip 34 disengages from the adjacent wall 26.

When water is again turned on and it emits as a jet impinging upon the curved lip 34 the nozzle 14, 29 is caused to move counterclockwise by virtue of the impingement of the jet. Thus the nozzle 14 rotates or indexes to the second position. In so doing and as the jet continues to emit through the nozzle, the lip 34 is moved outwardly sufficiently to engage the next adjacent wall 26 as may be visualized by observing the dotted line position of the nozzle 14 in FIG. 2. So long as water pressure continues when the nozzle 14 is in the position shown by the dotted lines water will emit through that particular passageway. Again, when water pressure is relieved the bellows member assumes its normal position and the lip 34 moves away from the adjacent wall 26 and the nozzle member is in position to index again when water pressure comes on for the next effort. In this manner the nozzle 14 moves around in a circle so long as water pressure is applied and relieved.

The flexible nozzle part 31 may be made of metal if desired so long as the resulting structure is sufficiently flexible or it may be made of a number of well-known synthetic or rubber-like materials.

Further modifications may be made without departing from the spirit and scope of the disclosure.

I claim:

1. A rotary indexing nozzle head comprising, a housing adapted to be received in a water supply source, a jet nozzle member having a discharge end mounted for rotation in said housing, holding members uniformly spaced around the periphery of said housing adjacent the discharge end of said nozzle member, and indexing means attached to the discharge end of said nozzle member, indexing means located in the path of water exiting from said nozzle member and impinged upon by such water for initially rotating said nozzle member and for moving into engagement with said holding members to terminate rotation of said nozzle member under the initiation and continuation of water flow through said nozzle.

2. The rotary indexing nozzle head according to claim 1 wherein said indexing means attached to the discharge end of said nozzle member comprises a member movable from a normal position to an outward position under the influence of water pressure and movable from the outward position to the normal position upon removal of water pressure through said nozzle.

3. The rotary indexing nozzle head according to claim 2 wherein said movable member has a projecting lip moved to such outward position for engaging said holding members only when said lip is in such outward position under the influence of water pressure.

4. The rotary indexing nozzle head according to claim 1 wherein said holding members comprise walls in said housing defining uniformly spaced fluid openings; and said indexing means is moved into engagement with said walls.

* * * * *